US009193042B2

(12) United States Patent
Picaza Ibarrondo

(10) Patent No.: US 9,193,042 B2
(45) **Date of Patent: *Nov. 24, 2015**

(54) PLIERS

(71) Applicant: ROTHENBERGER, S.A., Abadiano (Vizcaya) (ES)

(72) Inventor: Jose Ignacio Picaza Ibarrondo, Abadiano (ES)

(73) Assignee: ROTHENBERGER S.A., Abadiano (Vizcaya) (ES)

( * ) Notice: Subject to any disclaimer, the term of this patent is extended or adjusted under 35 U.S.C. 154(b) by 253 days.

This patent is subject to a terminal disclaimer.

(21) Appl. No.: 13/938,735

(22) Filed: Jul. 10, 2013

(65) Prior Publication Data

US 2014/0137709 A1 May 22, 2014

(30) Foreign Application Priority Data

Nov. 22, 2012 (ES) ..... 201231811

(51) Int. Cl.
*B25B 7/10* (2006.01)

(52) U.S. Cl.
CPC ..... *B25B 7/10* (2013.01)

(58) Field of Classification Search
CPC ..... B25B 7/10
See application file for complete search history.

(56) References Cited

U.S. PATENT DOCUMENTS

| | | | | |
|---|---|---|---|---|
| 2,913,943 | A * | 11/1959 | Carlson et al. | 81/412 |
| 5,845,551 | A * | 12/1998 | Putsch | 81/412 |
| 7,614,324 | B2 * | 11/2009 | Bocquet et al. | 81/411 |
| 7,681,477 | B2 * | 3/2010 | Alexander | 81/411 |
| 7,748,300 | B2 * | 7/2010 | Picaza Ibarrondo | 81/409.5 |
| 8,661,948 | B2 * | 3/2014 | DeBaker et al. | 81/405 |
| 8,695,464 | B2 * | 4/2014 | Herrmann | 81/409 |
| 2013/0255450 | A1 * | 10/2013 | Picaza Ibarrondo | 81/411 |
| 2014/0053694 | A1 * | 2/2014 | Lin Wu | 81/416 |

* cited by examiner

*Primary Examiner* — David B Thomas
(74) *Attorney, Agent, or Firm* — Lucas & Mercanti, LLP

(57) ABSTRACT

Pliers, with two handles, one male (1) and another female (2) that are joined to each other by a joint bolt (3); where:

the bolt (3) presents its reduction (31) centered and accompanied by two was (31*a*), (31*b*) which are housed in the orifice-housings (20); the spline (4) and the orifice-housing (5) are conjugated with each other and coaxial with the bolt itself (3); the spline (4) defines two corners (4*a*), (4*b*) opposite each other, to fit without turning in the orifice-housing (5), with conjugated shape; the female handle (2) defines a wall (2*a*) whose width is at least equal to the height of the spline (4): and the stud bolt (6) is threaded in the orifice (40) of the spline (4);

the bolt (3) defines an eccentric orifice (40) with two zones (40*a*), (40*b*) of different sections; the last threaded, the means to prevent the turning of the bolt (3) with respect to the female handle (2) are an eccentric stud bolt (6) with two zones (60*a*), (60*b*) conjugated with those of the eccentric orifice (40) where it is mounted.

2 Claims, 4 Drawing Sheets

PLIERS

CROSS-REFERENCE TO RELATED APPLICATIONS

This application claims the priority of ES P201231811 filed Nov. 22, 2012, which is incorporated by reference herein.

This invention refers to improvements in the pliers that are the object of Patent P201230503.

The pliers that are the object of patent P201230503 are comprised of two handles that are joined to each other by a joint bolt, where one of the handles defines a slotted, straight or curved window, in which the other handle can reach various working positions to vary the fastening capacity of the pliers mouth and are characterized in that they incorporate means to prevent the turning of the bolt-pin with respect to the handle that carries it and means to prevent the axial displacement of the bolt-pin with respect to both handles of the pliers.

The essence of the invention resides basically in using a single-component bolt, with a bolt configuration that prevents its turning and its axial movement with respect to its original location, resulting in very simplified pliers, and in the resolution of the known problems of said pliers.

In the pliers, according to the patent P201230503:

- the joint bolt is mounted fixed to one of the handles, with no turning or axial displacement with respect to it;
- the joint bolt, mounted without turning on one of the handles, has milling facing the slotted window of the other handle, with respect to which it can turn or lock (in order for said milling to allow or not to allow it from reaching the different working positions), but not displace axially;
- the joint bolt is mounted without protruding with respect to any side plane of the pliers, in order to not limit its possibilities of use or its operating functionality Maintaining these premises, the following vary in the improvements of this addition:

- the configuration of the joint bolt (which now presents the milling accompanied by two side faces);
- the configuration of the spline (which can now be centered/coaxial with the rest of the joint bolt or be eliminated);
- the configuration of the stud bolt (which can now be centered/coaxial with the spline and the joint bolt itself or offset/eccentric with respect to the joint bolt and present several zones, with different sections); and
- the configuration of the female handle itself in this zone (which can now present a thicker wall, the thickness of which is a minimum of the height of the spline).

The improvements of this invention with respect to the patent P201230503 are characterized in that:

a) the joint bolt presents its reduced zone or milling centered and accompanied by two side walls that are housed in the respective orifice-housings of the female handle;

b) the means to prevent the turning of the joint bolt with respect to the female handle comprise a spline and an orifice-housing conjugated with each other and centered/coaxial with the joint bolt itself; where

- the coaxial spline defines two corners opposite each other, to fit without turning in the coaxial orifice-housing which for this purpose presents conjugated shape; and
- the female handle defines a thick wall, the thickness of which is at least equal to the height of the coaxial spline;

c) the means to prevent the axial displacement of the bolt with respect to the female handle consist of a stud bolt in the threaded orifice of the coaxial spline; said stud bolt also being centered/coaxial with the spline with the orifice-housing and with the joint bolt itself.

The improvements of this invention with respect to the patent P201230503 are also characterized in that:

d) the joint bolt defines, from one of its side faces, an eccentric orifice which presents at least two zones of different sections, the last of which is threaded, totally or partially;

e) the means for mounting the joint bolt without turning with respect to the female handle (2) are comprised of:

- an eccentric orifice-housing provided on the female handle and facing an eccentric orifice provided in the joint bolt and which presents two zones of different sections; and
- one eccentric stud bolt which presents, at least, two zones of different sections, in correspondence with those of said eccentric orifice. The last of these zones is threaded, totally or partially, to mount the stud bolt in the joint bolt and thus also prevent its axial displacement with respect to the female handle.

Other configurations and advantages of the invention can be deduced from the following description, and from the related claims.

To better understand the object of these improvements, preferential forms of embodiment, subject to accessory changes which do not essentially alter it, are represented in the attached figures. In this case:

Figure 3A:
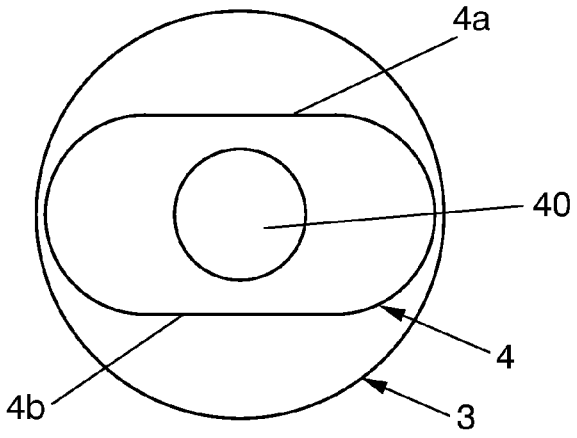

FIG. 3*a* represents a front view of the joint bolt (3), which corresponds with FIG. 5*a* of the main patent for this example of embodiment.

Figure 3B:
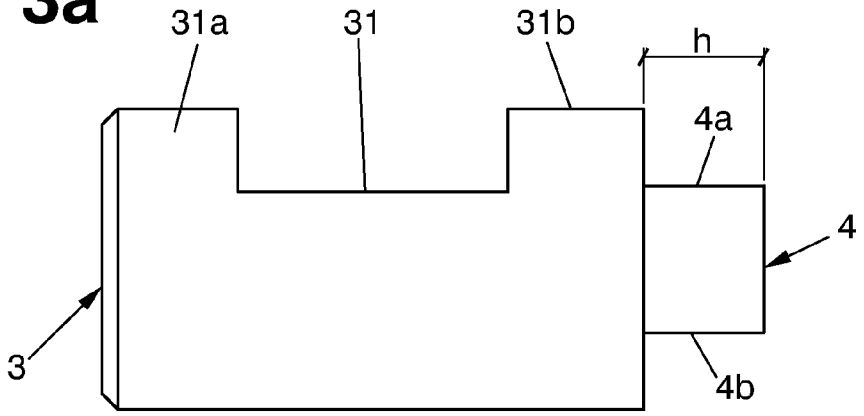

FIG. 3*b*, represents an elevated view of the bolt (3), which corresponds with FIG. 5*b* of the main patent for this example of embodiment.

Figure 3C:
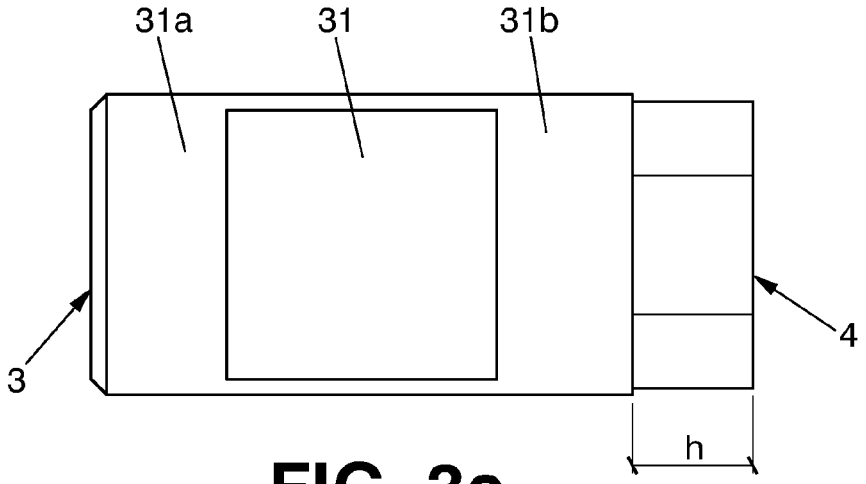

FIG. 3*c*, represents a plan view of the bolt (3) which corresponds with FIG. 5*c* of the main patent for this example of embodiment.

Figure 1:
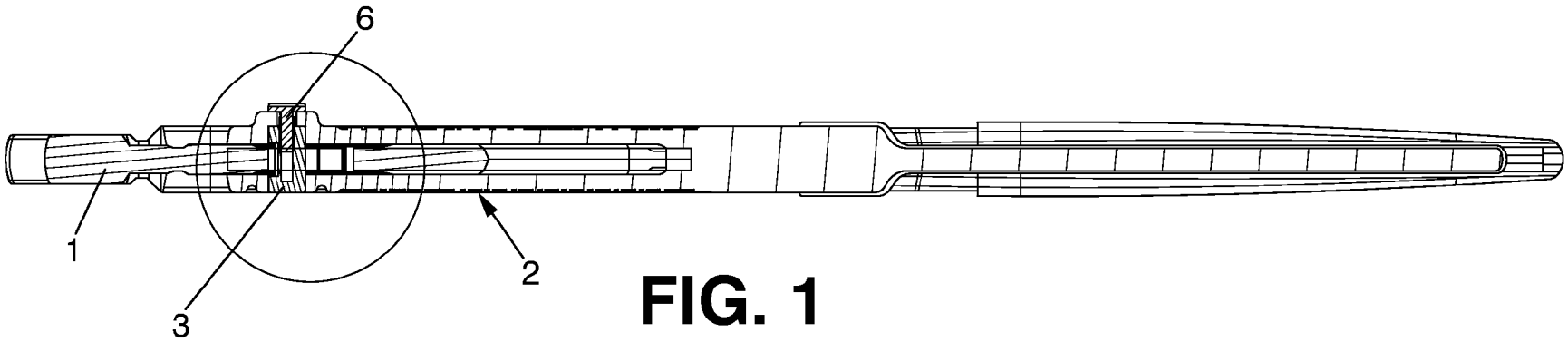
FIG. 1 represents a general section plan view, which corresponds to FIG. 2 of the main patent for this example of embodiment.
Figure 2:
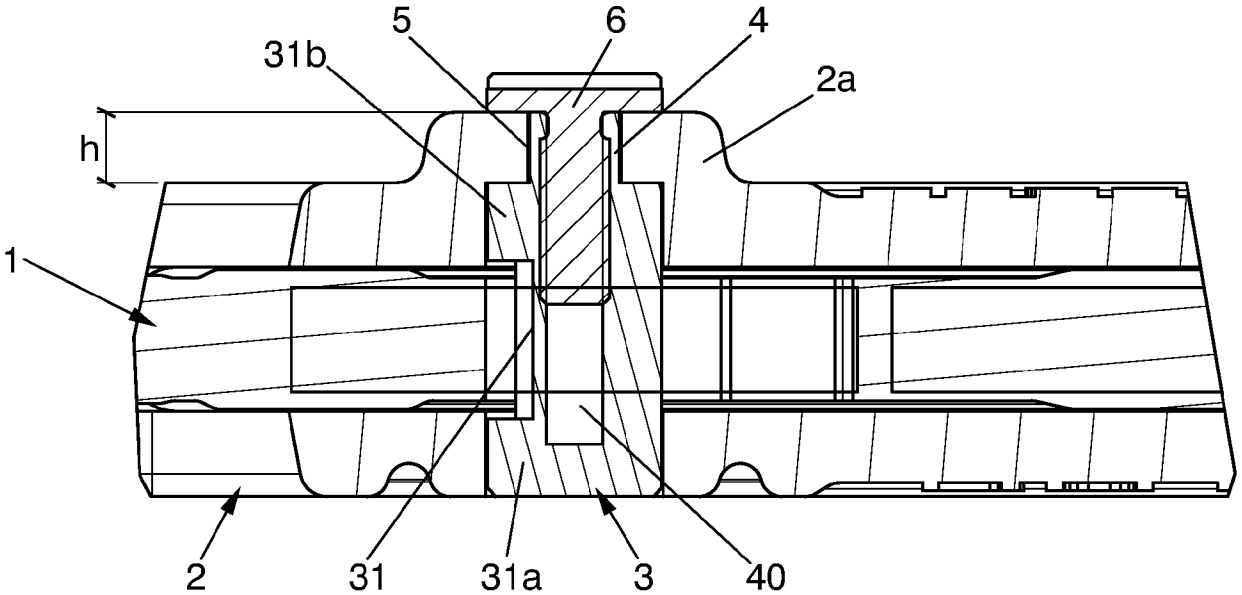
FIG. 2 represents a general enlarged view, according to detail of FIG. 1, which corresponds with FIG. 3 of the main patent for this example of embodiment.
Figure 4:
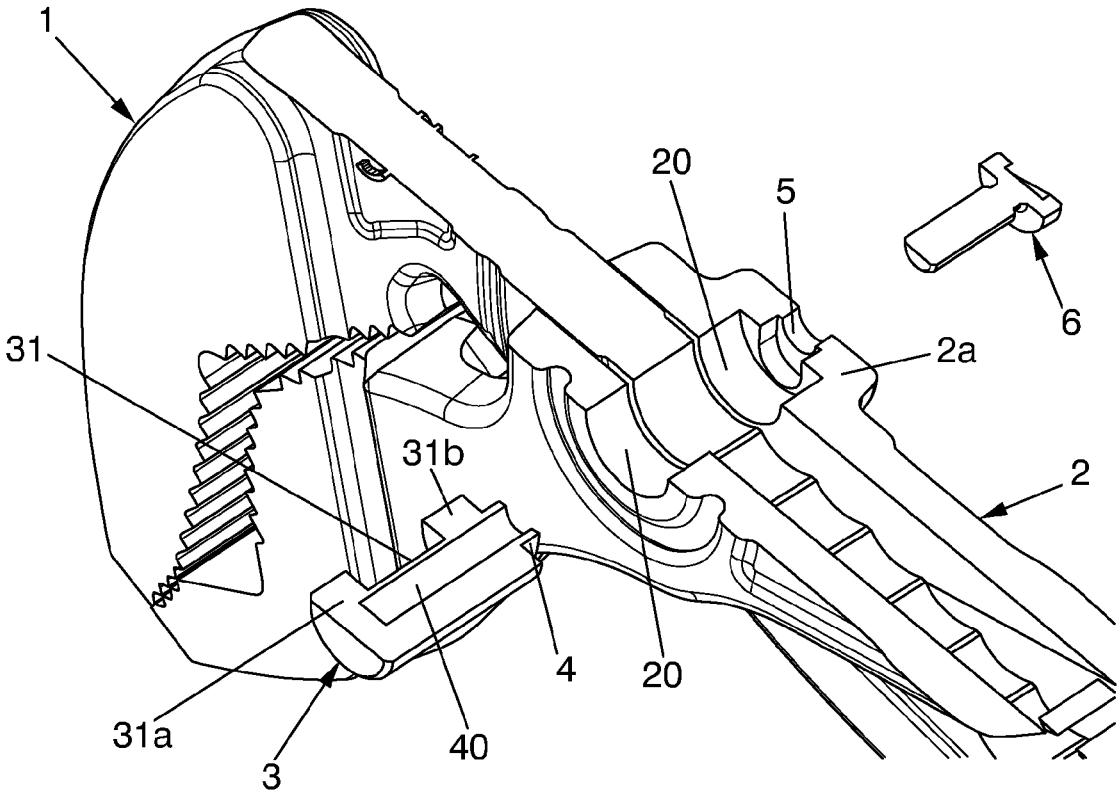

FIG. 4 represents a general schematic section in perspective corresponding with the embodiment of the foregoing FIGS. 1 to 3, with the basic components in assembly arrangement.

Figure 5:
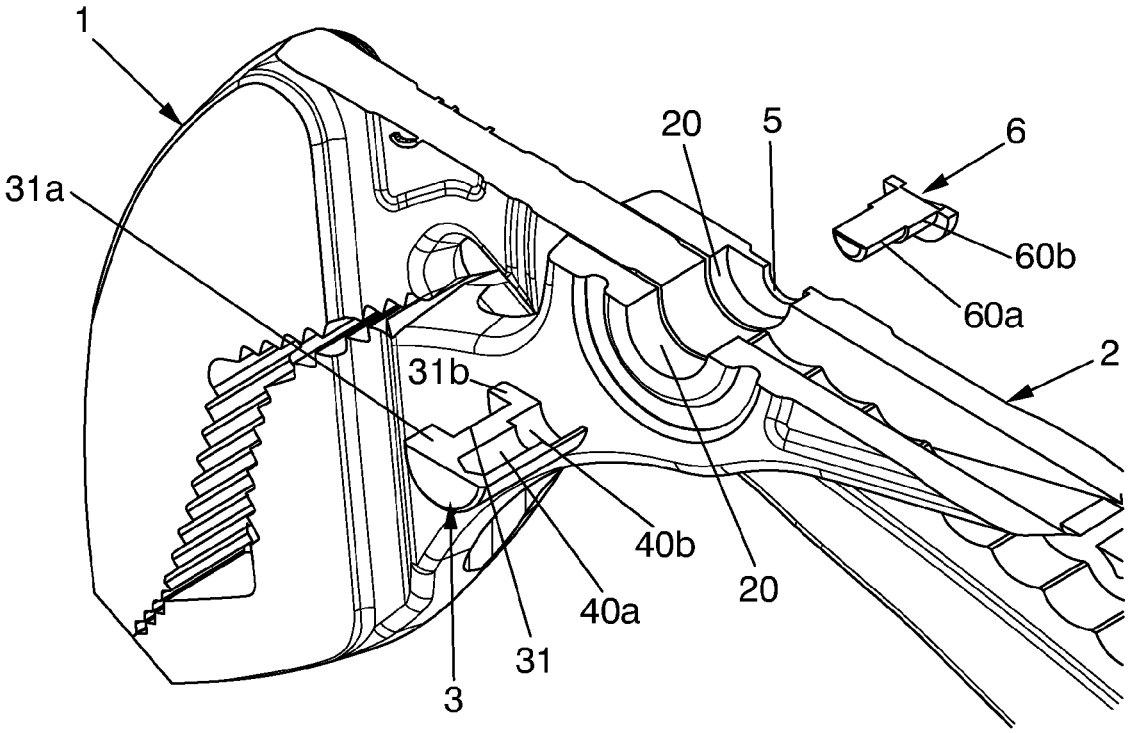

FIG. 5 represents a general schematic section in perspective similar to FIG. 4, but with the basic components in assembly arrangement for an alternative embodiment in which the spline (4) has been eliminated.

Figure 6:
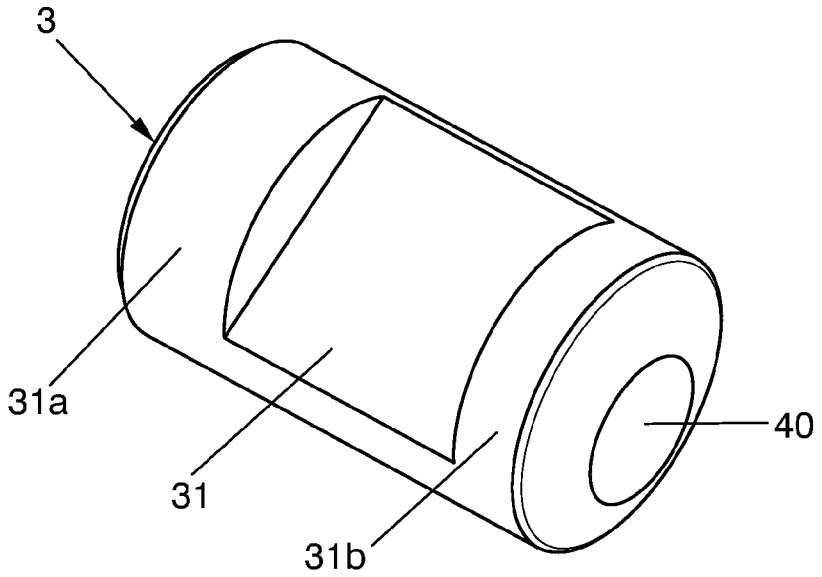

FIG. 6 represents a general schematic section in perspective of the joint bolt (3) for the example of embodiment of FIG. 5.

The following is an example of practical, non-limiting embodiment of this invention. Other ways of embodiment in which accessory changes which do not essentially alter it are introduced are in no way disregarded.

The object of the invention refers to pliers of the type comprised of two handles: one male (1) and the other female (2) which are joined to each other by a joint bolt (3); and where the male handle (1) defines a slotted window (11), of straight or curved configuration, along which the female handle (2) can take various working positions to vary the fastening capacity of the mouth.

In a known way, male handle (1) defines the slotted window (11), of straight or curved configuration, with toothed or grooved was (11*a*) and the female handle (2) defines two orifice-housings (20) facing each other on their walls. The joint bolt (3) is mounted on said orifices of the female handle (1). Said joint bolt (3) has conformations (31), such as a reduced zone or milling, which allow it to move or prevent it from moving in the slotted window (11) of the male handle (2) to reach the different working positions.

The slotted window (11 can be of straight or of curved configuration; therefore, the joint bolt (3) can have a straight or curved trajectory.

In the patent P201230503, the female handle (2) mounts in itself the joint bolt (3) with no possibility of turning or axial displacement. This joint bolt (3) is also mounted without axial displacement with respect to both handles (1), (2) of the pliers.

In conformity with the invention, and according to the embodiment represented in FIGS. 1 to 4:

the female handle (2) presents on one of its wings a thick wall (2*a*) on which it defines in continuity with the orifice-housing (20) of said wall (2*a*), a concentric orifice-housing (5). The thickness of said wall (2*a*) is at least equal to the height (h) of the spline (4) described later;

the joint bolt (3) defines a reduced zone (31) centered and accompanied by two walls (31*a*), (31*b*) which comprise the rest of the body of the bolt (3). It also defines the aforementioned spline (4), which is coaxial with the body of the bolt itself (3) and presents continuity with it;

the coaxial spline (4) defines two corners opposite each other (4*a*), (4*b*) to fit without turning on the orifice-housing (5) which for this purpose presents conjugated shape;

from the coaxial spline (4) there extends an axial orifice (40) which continues inside the joint bolt (3). This axial orifice (40) is threaded (totally or partially) in correspondence with the threading (total or partial) of the stud bolt (6).

To perform the mounting of the joint bolt (3) without turning with respect to the female handle (2), the coaxial spline (4) is housed in the orifice-housing (5) while the bolt (3) houses the zones of its side walls (31*a*), (31*b*) in the orifice-seats (20) of the female handle (2).

To fix this position and prevent the joint bolt (3) from having lateral displacement with respect to the handles (1), (2), there is a stud bolt (6) in the axial orifice (40) of the coaxial spline (4); said stud bolt (6) also being centred/coaxial with the spline (4) with the orifice-housing (5) and with the joint bolt itself (3).

In conformity with this invention, and according to the embodiment represented in FIGS. 5 and 6:

the female handle (2) presents the same configuration as the patent P201230503, defining in continuity with the orifice-housing (20) of the wall of this side, an eccentric orifice-housing (5);

the joint bolt (3) defines a reduced zone (31) centered and accompanied by two walls (31*a*), (31*b*) which comprise the rest of the body of the bolt (3). The eccentric orifice (40) extends to the interior of the joint bolt (3) from one of its side faces and presents at least two zones (40*a*), (40*b*) of different sections, the last of which is threaded (totally or partially) in correspondence with the threading (total or partial) of the final zone of the stud bolt (6) described later;

the stud bolt (6) presents at least two zones (60*a*), (60*b*) of different sections, in correspondence with the zones (40*a*), (40*b*) of the eccentric orifice (40). At least the last of these zones (60*a*) is threaded (totally or partially) in correspondence with the threading (total or partial) of the final zone (40*a*) of the eccentric orifice (40) described previously.

To perform the mounting of the joint bolt (3) without turning with respect to the female handle (2), the stud bolt (6) crosses the eccentric orifice-housing (5) and is housed in the eccentric orifice (40) provided in the joint bolt (3).

The bolt (3) houses the zones of its side walls (31*a*), (31*b*) in the orifice-seats (20) of the female handle (2) and the eccentric orifice (40) of the joint bolt (3) faces the eccentric orifice-housing (5) provided in the wall of the female handle (2).

To fix this position and prevent the joint bolt (3) from having side displacement with respect to the handles (1), (2), the stud bolt (6) is arranged in the axial orifice (4)) so that its zone is housed (60*b*) in the zone (40*b*) of the eccentric orifice (40) and threads its zone (60*a*) in the zone (40*a*) of the eccentric orifice (40).

The remaining possibilities for assembly, operation and constructive solutions described for the patent P201230503 are applicable to this addition.

The materials, dimensions, proportions and, in general, those other accessory or secondary details which do not essentially alter, change or modify the proposal may be variable.

The terms in which this report is written are a true reflection of the object described, and must be taken in their broadest sense and never in a limiting manner.

The invention claimed is:

1. Pliers, comprising:

two handles, one male and another female, that are joined to each other by a joint bolt;

the male handle defines a slotted window, of straight or curved configuration, the walls of which carry teeth or grooves;

along said slotted window the female handle can reach different working positions to vary the fastening capacity of a mouth of the pliers, and where the joint bolt presents a reduced zone in correspondence with the teeth or grooves of the slotted window;

the joint bolt is mounted on the female handle with means to prevent the turning of the bolt with respect to the female handle, and means to prevent the axial displacement of the bolt with respect to the female handle;

the joint bolt includes the reduced zone centered and accompanied by two side walls which are housed in the respective orifice-housings of the female handle;

the means to prevent the turning of the bolt with respect to the female handle are comprised of a spline and an orifice-housing conjugated with each other and centered/coaxial with the bolt itself;

the coaxial spline defines two corners opposite each other, to fit without turning in the coaxial orifice-housing which for this purpose presents conjugated shape;

the female handle defines a thick wall the thickness of which is at least equal to a height of the coaxial spline; and the means to prevent the axial displacement of the bolt with respect to the female handle include a stud bolt in a threaded orifice of the coaxial spline; said stud bolt also being centered/coaxial with the spline, with the orifice-housing and with the joint bolt itself.

2. The pliers of claim 1, wherein:

the joint bolt defines, from one of its side faces, an eccentric orifice which includes at least first and second zones of different sections, the second zone being totally or partially threaded; and the means to mount without turning the joint bolt with respect to the female handle are comprised of:

the eccentric orifice-housing provided in the female handle and facing the eccentric orifice provided in the bolt; and the eccentric stud-bolt which includes, at least, third and fourth zones of different sections, in correspondence with the zones of said eccentric orifice; the fourth zone being totally or partially threaded, to mount the stud bolt in the joint bolt and thus prevent the axial displacement of the bolt with respect to the female handle.

* * * * *